US011215026B2

(12) United States Patent
Palmer et al.

(10) Patent No.: US 11,215,026 B2
(45) Date of Patent: Jan. 4, 2022

(54) LOCKING BACKPRESSURE VALVE

(71) Applicants: Larry Thomas Palmer, Spring, TX (US); Erik Van Steveninck, Houston, TX (US); Erik Vilhelm Nordenstam, The Woodlands, TX (US); Eric Anders Erickson, Bozeman, MT (US); Scott Bigrigg, Canonsburg, PA (US)

(72) Inventors: Larry Thomas Palmer, Spring, TX (US); Erik Van Steveninck, Houston, TX (US); Erik Vilhelm Nordenstam, The Woodlands, TX (US); Eric Anders Erickson, Bozeman, MT (US); Scott Bigrigg, Canonsburg, PA (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 16/889,900

(22) Filed: Jun. 2, 2020

(65) Prior Publication Data

US 2021/0372226 A1 Dec. 2, 2021

(51) Int. Cl.
*E21B 34/08* (2006.01)
*E21B 34/14* (2006.01)

(52) U.S. Cl.
CPC ..... *E21B 34/08* (2013.01); *E21B 34/142* (2020.05); *E21B 2200/05* (2020.05)

(58) Field of Classification Search
CPC .... E21B 34/08; E21B 2200/05; E21B 34/142; E21B 34/14; E21B 34/12
See application file for complete search history.

(56) References Cited

U.S. PATENT DOCUMENTS 3,289,693 A 12/1966 Scaramucci
3,376,935 A 4/1968 Baker
(Continued)

FOREIGN PATENT DOCUMENTS

CN 103410491 A 11/2013
CN 110173233 A 8/2019
(Continued)

OTHER PUBLICATIONS

International Search Report and Written Opinion for International Application No. PCT/US2021/034166; International Filing Date May 26, 2021; Report dated Aug. 27, 2021 (pp. 1-11).
(Continued)

*Primary Examiner* — Michael R Wills, III
(74) *Attorney, Agent, or Firm* — Cantor Colburn LLP

(57) ABSTRACT

A downhole tool includes a tubular having an outer surface and an inner surface defining a flowbore having a longitudinal axis and a backpressure valve arranged in the flowbore. The backpressure valve includes a flapper valve including a hinge end, a cantilevered end, a first side and an opposing second side pivotally mounted to the inner surface at the hinge end to selectively extend across the flowbore, and a locking system mounted to the inner surface adjacent to the hinge end of the flapper valve in the flowbore. The flapper valve is pivotable between a first position, wherein the flapper valve is free to pivot relative to the inner surface between an open configuration and a closed configuration, and a second position, wherein the hinge end of the flapper valve activates the locking system to lock the flapper valve in the open configuration.

20 Claims, 4 Drawing Sheets

(56) References Cited

U.S. PATENT DOCUMENTS

| | | | | |
|---|---|---|---|---|
| 3,951,338 | A | 4/1976 | Genna | |
| 3,958,633 | A | 5/1976 | Britch et al. | |
| 4,033,429 | A * | 7/1977 | Farr | E21B 47/14 181/106 |
| 4,100,969 | A | 7/1978 | Randermann, Jr. | |
| 4,220,206 | A | 9/1980 | Van Winkle | |
| 4,393,930 | A | 7/1983 | Ross et al. | |
| 4,407,329 | A | 10/1983 | Huebsch et al. | |
| 4,474,241 | A | 10/1984 | Freeman | |
| 4,566,541 | A | 1/1986 | Moussy et al. | |
| 4,597,449 | A | 7/1986 | Keeney | |
| 4,676,307 | A | 6/1987 | Pringle | |
| 4,729,432 | A | 3/1988 | Helms | |
| 4,782,895 | A | 11/1988 | Jacob et al. | |
| 5,022,427 | A | 6/1991 | Churchman et al. | |
| 5,159,981 | A | 11/1992 | Le | |
| 5,496,044 | A | 3/1996 | Beall et al. | |
| 6,260,850 | B1 | 7/2001 | Beall et al. | |
| 6,446,665 | B2 | 9/2002 | Coscarella | |
| 6,547,007 | B2 | 4/2003 | Szarka et al. | |
| 6,568,470 | B2 | 5/2003 | Goodson, Jr. et al. | |
| 6,957,703 | B2 | 10/2005 | Trott et al. | |
| 7,063,156 | B2 * | 6/2006 | Patel | E21B 34/12 166/332.8 |
| 7,299,880 | B2 | 11/2007 | Logiudice et al. | |
| 7,360,600 | B2 | 4/2008 | MacDougall et al. | |
| 7,665,528 | B2 | 2/2010 | Ross et al. | |
| 8,607,811 | B2 | 12/2013 | Korkmaz | |
| 8,893,796 | B2 | 11/2014 | Conner et al. | |
| 8,955,543 | B2 | 2/2015 | Groesbeck et al. | |
| 9,163,479 | B2 * | 10/2015 | Rogers | E21B 34/066 |
| 10,619,448 | B1 | 4/2020 | Watson et al. | |
| 2001/0023706 | A1 | 9/2001 | Coscarella | |
| 2003/0121665 | A1 | 7/2003 | Trott | |
| 2004/0060704 | A1 | 4/2004 | Layton et al. | |
| 2007/0137869 | A1 | 6/2007 | MacDougall et al. | |
| 2010/0139923 | A1 | 6/2010 | Biddick | |
| 2010/0212907 | A1 | 8/2010 | Frazier | |
| 2011/0088908 | A1 * | 4/2011 | Xu | E21B 34/10 166/332.8 |
| 2011/0174505 | A1 | 7/2011 | Gill et al. | |
| 2011/0290344 | A1 | 12/2011 | Groesbeck et al. | |
| 2012/0305257 | A1 * | 12/2012 | Conner | E21B 21/10 166/323 |
| 2012/0321446 | A1 | 12/2012 | Blewett et al. | |
| 2014/0020904 | A1 | 1/2014 | Hill, Jr. | |
| 2015/0136404 | A1 | 5/2015 | Groesbeck et al. | |
| 2015/0211333 | A1 | 7/2015 | Vick, Jr. et al. | |
| 2016/0138365 | A1 | 5/2016 | Vick, Jr. et al. | |
| 2016/0138368 | A1 * | 5/2016 | Girola | E21B 21/106 166/332.8 |
| 2016/0230503 | A1 | 8/2016 | Holmberg et al. | |
| 2016/0281465 | A1 * | 9/2016 | Grayson | E21B 34/00 |
| 2016/0341002 | A1 * | 11/2016 | McKitrick, III | E21B 34/14 |
| 2017/0175488 | A1 * | 6/2017 | Lisowski | E21B 43/267 |
| 2017/0370186 | A1 | 12/2017 | Stair | |
| 2018/0058177 | A1 | 3/2018 | Bigrigg et al. | |
| 2018/0209246 | A1 | 7/2018 | Miller et al. | |
| 2018/0334833 | A1 | 11/2018 | Brewer | |
| 2018/0334883 | A1 | 11/2018 | Williamson | |
| 2018/0347301 | A1 * | 12/2018 | Hilliard | E21B 34/10 |
| 2019/0003286 | A1 * | 1/2019 | Bigrigg | E21B 37/00 |
| 2019/0331235 | A1 * | 10/2019 | Prather | E21B 34/10 |
| 2019/0338620 | A1 | 11/2019 | Burris et al. | |
| 2020/0190941 | A1 * | 6/2020 | Watson | E21B 34/142 |

FOREIGN PATENT DOCUMENTS

| | | | |
|---|---|---|---|
| EP | 2535504 | A1 | 12/2012 |
| EP | 3561220 | A1 | 10/2019 |
| WO | 2004031534 | A1 | 4/2004 |
| WO | 2006024811 | A1 | 3/2006 |
| WO | 2007073401 | A1 | 6/2007 |
| WO | 2007125335 | A1 | 11/2007 |
| WO | 2017052556 | A1 | 3/2017 |

OTHER PUBLICATIONS

International Search Report and Written Opinion for International Application No. PCT/US2021/034170; International Filing Date May 26, 2021; Report dated Aug. 27, 2021 (pp. 1-11).

International Search Report and Written Opinion for International Application No. PCT/US2019/026878; International Filing Date Apr. 11, 2019; Report dated Jul. 26, 2019 (pp. 1-8).

International Search Report and Written Opinion for International Application No. PCT/US2021/034167; International Filing Date May 26, 2021; dated Sep. 14, 2021 (pp. 1-10).

International Search Report and Written Opinion for International Application No. PCT/US2021/034168; International Filing Date May 26, 2021; dated Sep. 3, 2021 (pp. 1-11).

International Search Report and Written Opinion for International Application No. PCT/US2021/034173; International Filing Date May 26, 2021; dated Sep. 16, 2021 (pp. 1-10).

International Search Report and Written Opinion for International Application No. PCT/US2021/034174; International Filing Date May 26, 2021; dated Aug. 30, 2021 (pp. 1-10).

International Search Report and Written Opinion for International Application No. PCT/US2021/034175; International Filing Date May 26, 2021; dated Sep. 16, 2021 (pp. 1-11).

* cited by examiner

LOCKING BACKPRESSURE VALVE

BACKGROUND

In the drilling and completion industry boreholes are formed to provide access to a resource bearing formation. Occasionally, it is desirable to install a plug in the borehole in order to isolate a portion of the resource bearing formation. When it is desired to access the portion of the resource bearing formation to begin production, a drill string is installed with a bottom hole assembly including a bit or mill. The bit or mill is operated to cut through the plug. After cutting through the plug, the drill string is removed, and a production string is run downhole to begin production. Withdrawing and running-in strings including drill strings and production strings is a time consuming and costly process. The industry would be open to systems that would reduce costs and time associated with plug removal and resource production.

SUMMARY

Disclosed is a downhole tool including a tubular having an outer surface and an inner surface defining a flowbore having a longitudinal axis and a backpressure valve arranged in the flowbore. The backpressure valve includes a flapper valve including a hinge end, a cantilevered end, a first side and an opposing second side pivotally mounted to the inner surface at the hinge end to selectively extend across the flowbore, and a locking system mounted to the inner surface adjacent to the hinge end of the flapper valve in the flowbore. The flapper valve is pivotable between a first position, wherein the flapper valve is free to pivot relative to the inner surface between an open configuration and a closed configuration, and a second position, wherein the hinge end of the flapper valve activates the locking system to lock the flapper valve in the open configuration.

Also disclosed is a resource exploration and recovery system including a first system and a second system fluidically connected to the first system. The second system includes at least one tubular extending into a formation. The at least one tubular supports a downhole tool and including an outer surface and an inner surface defining a flow path having a longitudinal axis. The downhole tool further includes a backpressure valve arranged in the flow path. The backpressure valve includes a flapper valve having a hinge end, a cantilevered end, a first side and an opposing second side pivotally mounted to the inner surface at the hinge end to selectively extend across the flowbore, and a locking system mounted to the inner surface adjacent to the hinge end of the flapper valve in the flowbore. The flapper valve is pivotable between a first position, wherein the flapper valve is free to pivot relative to the inner surface between an open configuration and a closed configuration, and a second position, wherein the hinge end of the flapper valve activates the locking system to lock the flapper valve in the open configuration.

Still further disclosed is a method of operating a backpressure valve including pivoting a flapper valve to a closed configuration to prevent fluid flow through flowbore in a backpressure valve during a milling operation, pumping off a bottom hole assembly at a completion of the milling operation, introducing an object into a tubular string supporting the backpressure valve, shifting a flapper valve to an open configuration with the object, shifting a locking mechanism with a hinge end of the flapper valve, and releasing the locking mechanism to lock the flapper valve in the open configuration, the flapper valve forming a surface of the flowbore.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
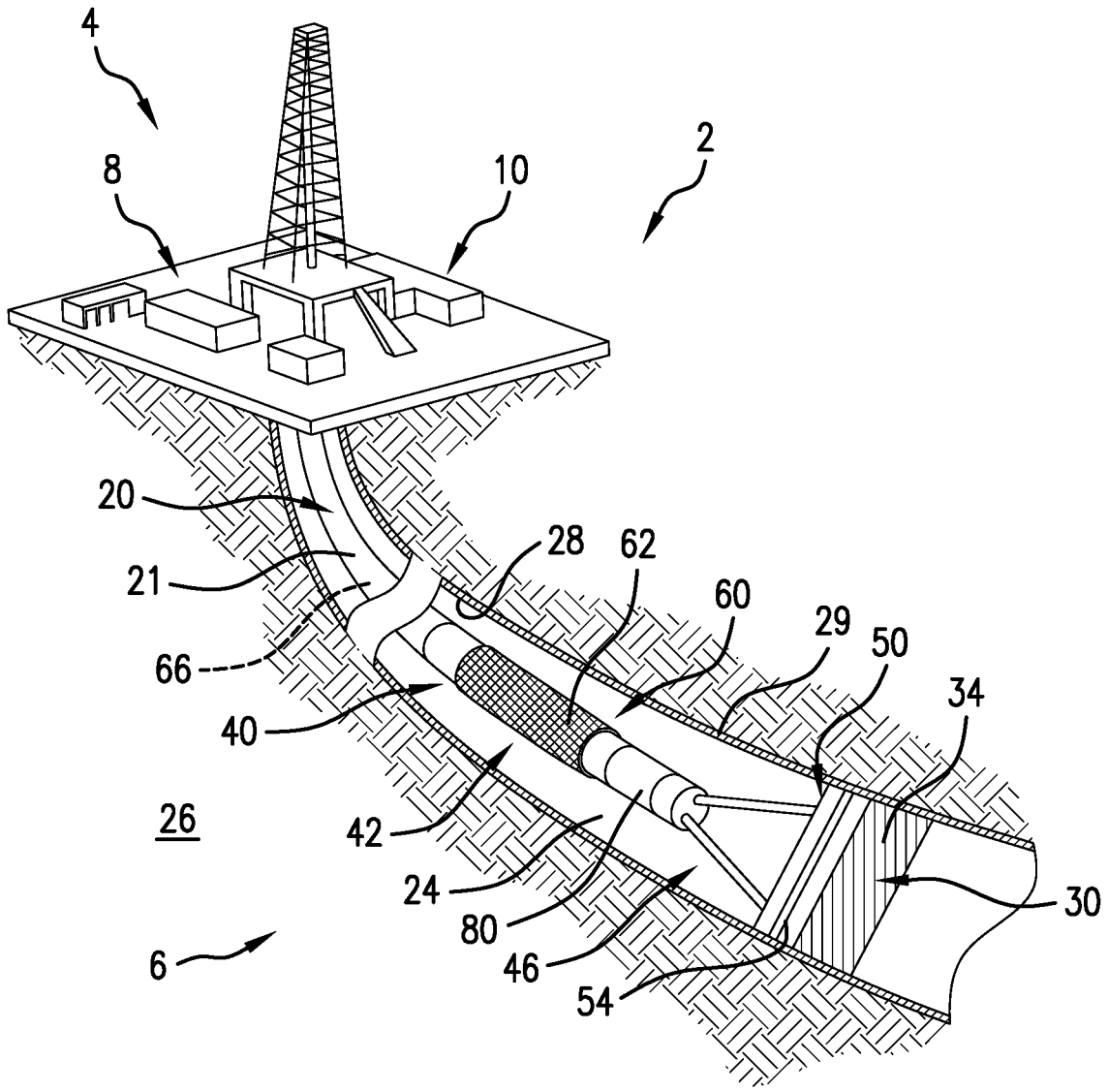
FIG. 1 depicts a resource exploration and recovery system including a locking backpressure valve, in accordance with an exemplary embodiment.

A resource exploration and recovery system, in accordance with an exemplary embodiment, is indicated generally at 2, in FIG. 1. Resource exploration and recovery system 2 should be understood to include well drilling operations, resource extraction and recovery, $CO_2$ sequestration, and the like. Resource exploration and recovery system 2 may include a first system 4 which takes the form of a surface system operatively connected to a second system 6 which takes the form of a subsurface or subterranean system. First system 4 may include pumps 8 that aid in completion and/or extraction processes as well as fluid storage 10. Fluid storage 10 may contain a gravel pack fluid or slurry, or drilling mud (not shown) or other fluid which may be introduced into second system 6.

Second system 6 may include a downhole string 20 formed from at least one tubular such as indicated at 21 that is extended into a wellbore 24 formed in formation 26. Wellbore 24 includes an annular wall 28 that may be defined by a wellbore casing 29 provided in wellbore 24. Of course, it is to be understood, that annular wall 28 may also be defined by formation 26. In the exemplary embodiment shown, subsurface system 6 may include a downhole zonal isolation device 30 that may form a physical barrier between one portion of wellbore 24 and another portion of wellbore 24. Downhole zonal isolation device 30 may take the form of a bridge plug 34. Of course, it is to be understood that downhole zonal isolation device 30 may take on various forms including frac plugs formed from composite materials and/or metal, sliding sleeves and the like.

In further accordance with an exemplary embodiment, downhole string 20 defines a drill string 40 including a plug removal and production system 42. Plug removal and production system 42 is arranged at a terminal end portion (not separately labeled) of drill string 40. Plug removal and production system 42 includes a bottom hole assembly (BHA) 46 having a plug removal member 50 which may take the form of a bit or a mill 54. Of course, it is to be understood that plug removal member 50 may take on various forms such as a mill or a bit. BHA 46 may take on a variety of forms known in the art.

Plug removal and production system 42 includes a selective sand screen 60 arranged uphole of BHA 46. Selective sand screen 60 includes a screen element 62 that is arranged over a plurality of openings (not shown) formed in drill string 40. It is to be understood that the number of screen elements may vary. Further, it is to be understood that screen opening size may vary. It is also to be understood that screen element 62 may include a number of screen layers. The openings in drill string 40 fluidically connect wellbore 24 with a flow path 66 extending through drill string 40.

Figure 2:
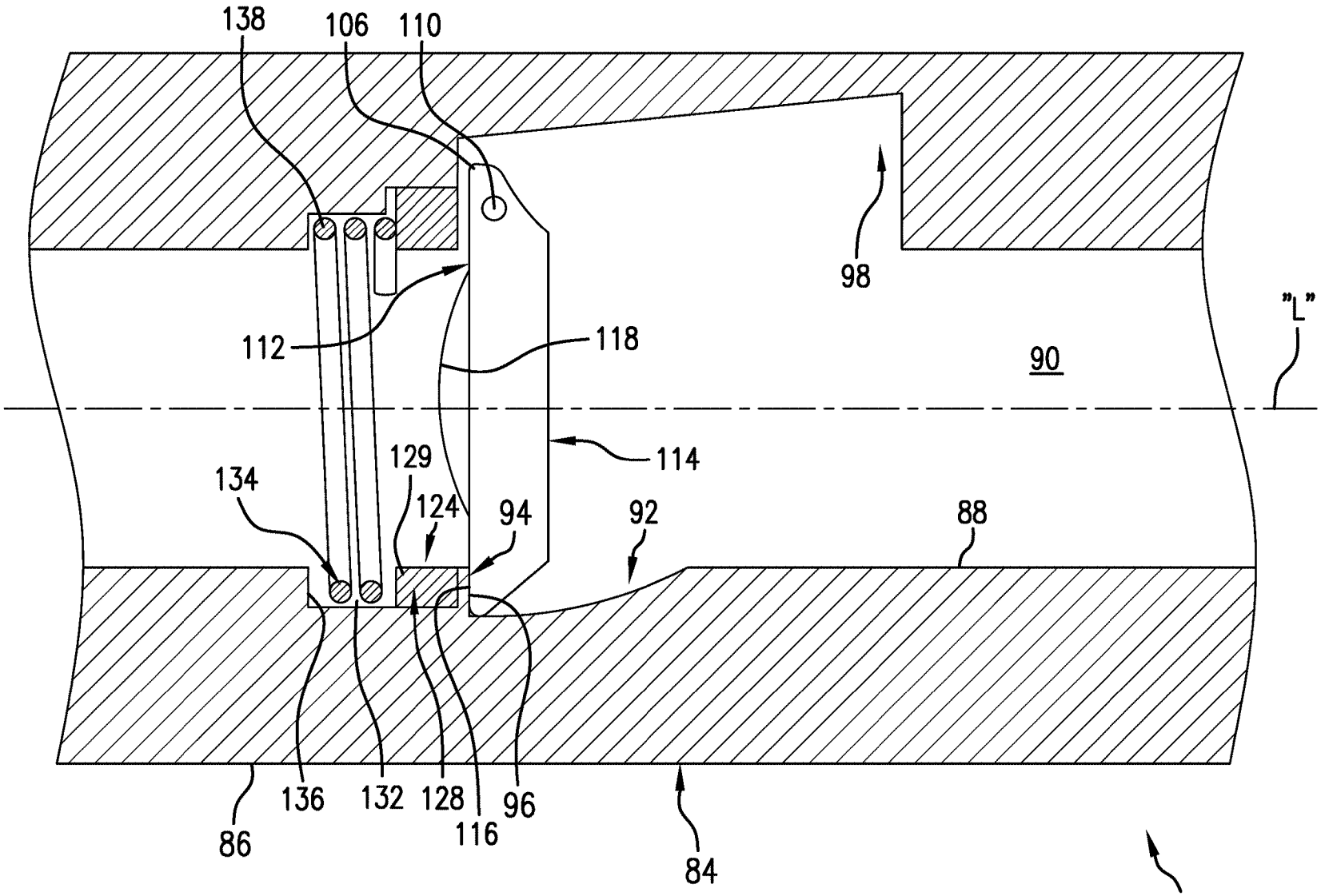
FIG. 2 depicts a cross-sectional side view of the locking backpressure valve in a run-in configuration, in accordance with an exemplary aspect.

In yet still further accordance with an exemplary embodiment, plug removal and production system 42 includes a backpressure valve (BPV) 80 arranged downhole of selective sand screen 60 and uphole of BHA 46. Referring to FIG. 2, BPV 80 includes a housing (not separately labeled) defined by a tubular 84 that forms part of drill string 40. Tubular 84 includes an outer surface 86 and an inner surface 88 that defines a flowbore 90 having a longitudinal axis "L" that receives BPV 80. Inner surface 88 includes a recess 92 having a wall 94. Wall 94 extends substantially perpendicularly relative to flowbore 90 and defines a first portion (not separately labeled) of a valve seat 96. While valve seat 96 is shown to be integrally formed with tubular 84, it should be understood that a valve seat may be provided as a separate component.

In an embodiment, recess 92 includes a valve receiving portion 98. A flapper valve 104 is mounted in valve receiving portion 98. Flapper valve 104 includes a first or hinge end 106 and a second or cantilevered end 108. Flapper valve 104 is pivotally supported in valve receiving portion by a hinge 110 connected to hinge end 106. Flapper valve 104 includes a first side 112 and an opposing second side 114 that extend between hinge end 106 and cantilevered end 108. First side 112 includes a sealing surface 116 that engages with valve seat 96. First side 112 also includes a pivot nub 118. Pivot nub 118 is a generally semi-spherical protrusion extending outwardly from first side 112.

In an embodiment, BPV 80 includes a locking system 124 mounted in tubular 84. Locking system 124 includes a selectively shiftable locking member 128 shown in the form of a locking ring 129 arranged in a recess portion 132 formed in inner surface 88 of tubular 84 uphole of recess 92. A section of locking ring 129 adjacent hinge end 106 (not separately labeled) may define a second portion (also not separately labeled) of valve seat 96. Locking system 124 is further shown to include a biasing member 134 arranged between selectively shiftable locking member 128 and an annular wall 136 defining recess portion 132. Biasing member 134 make take the form of a coil spring 138 that urges selectively shiftable locking member 128 toward flapper valve 104.

In accordance with an exemplary embodiment, after mill 54 opens a downhole most plug (not shown), BHA 46 may be pumped off and allowed to fall and collect at a toe (not shown) of wellbore 24. During drilling, flapper valve 104 is arranged in the first position (FIG. 2). In the first position, flapper valve 104 is free to pivot about a 90° arc within flowbore 90. In this manner, drilling fluids may pass downhole toward BHA 46, but pressure may not pass uphole beyond BPV 80. That is, pressure moving in an uphole direction, e.g., toward first system 4, would act against second side 114 causing flapper valve 104 to close against valve seat 96.

Figure 3:
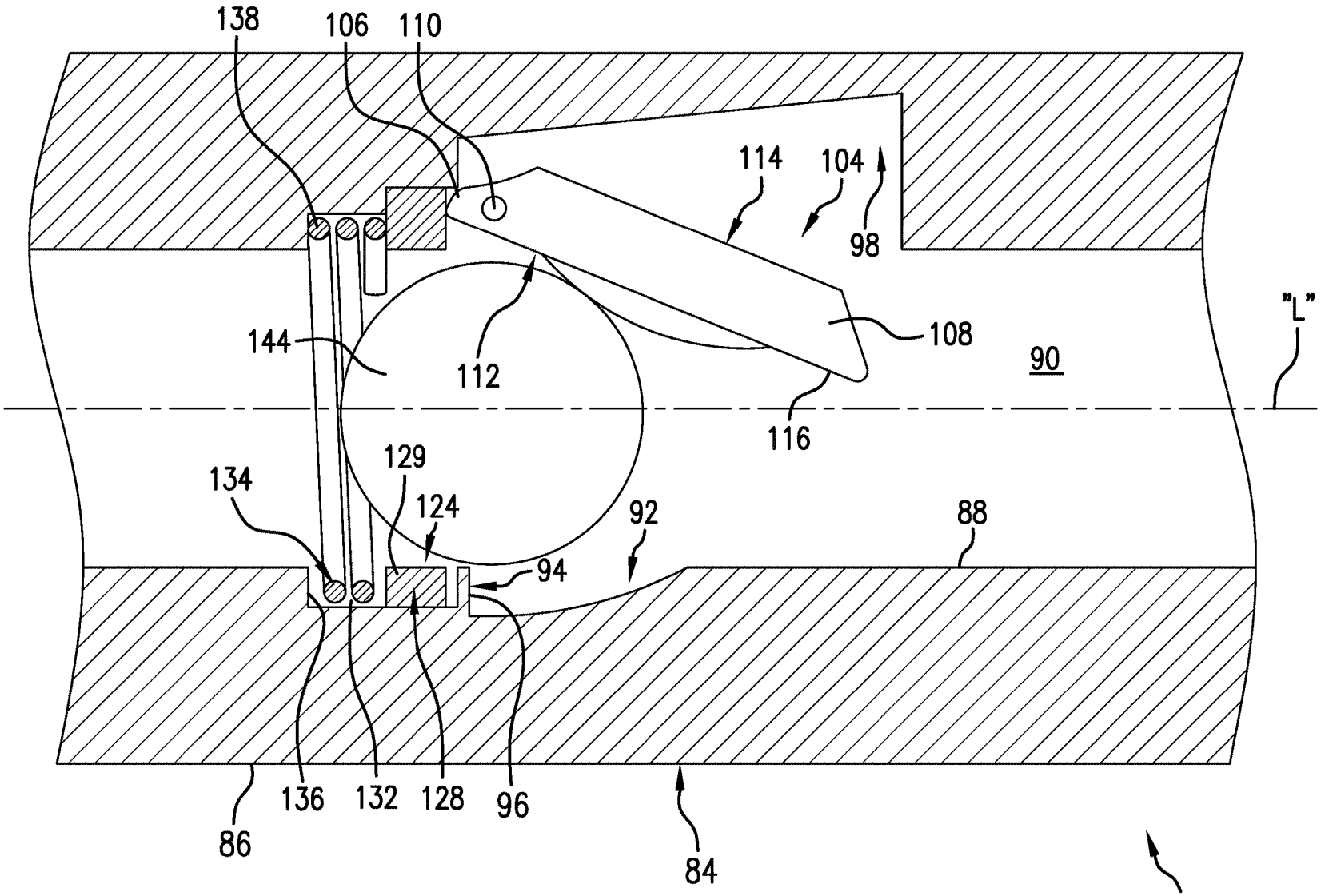
FIG. 3 depicts a cross-sectional side view of the locking backpressure valve showing an object shifting a flapper valve open.
Figure 4:
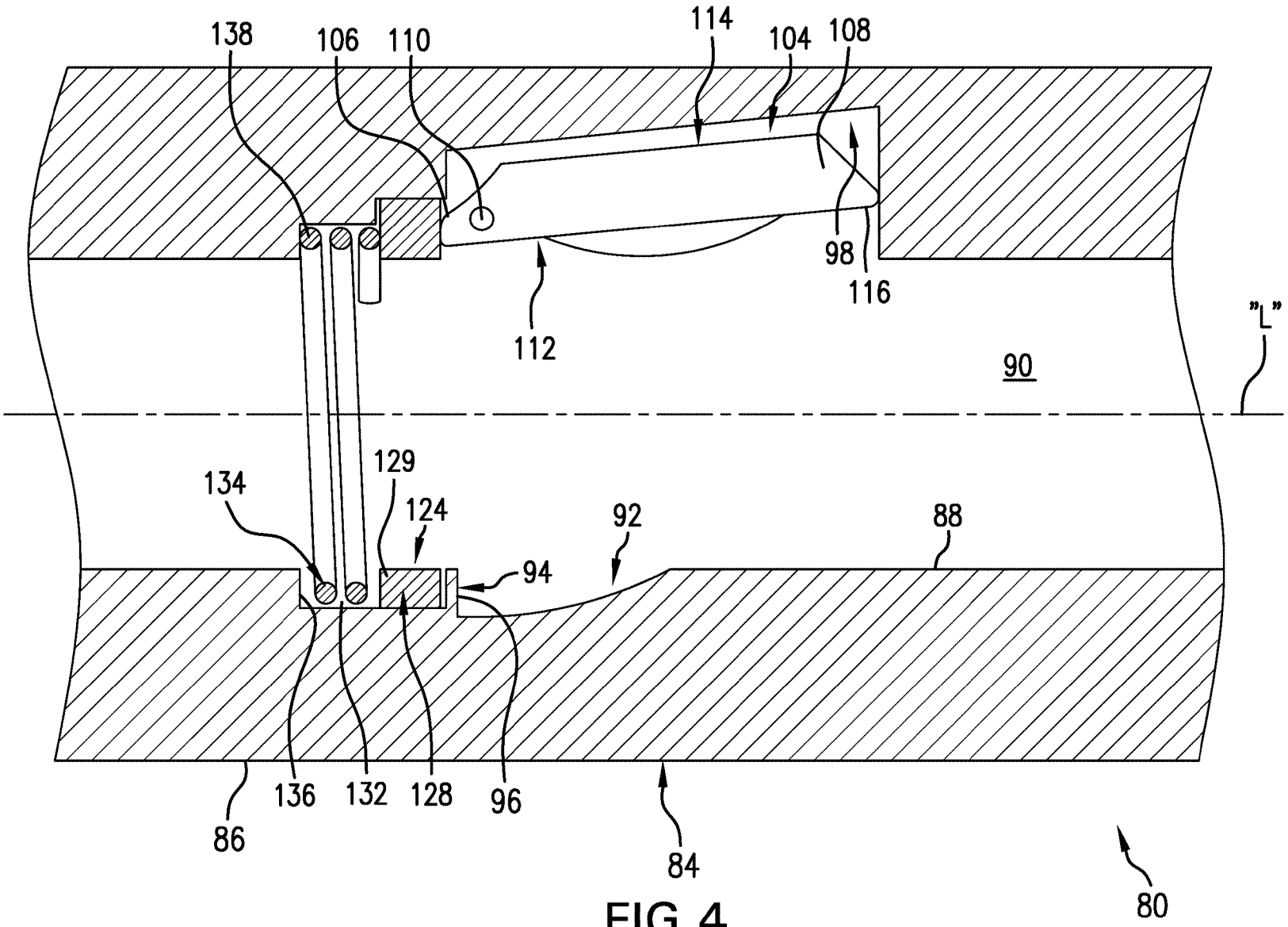
FIG. 4 depicts a cross-sectional side view of the locking backpressure valve a production configuration with the flapper valve locked open, in accordance with an exemplary aspect.

After pumping off BHA 46, it may be desirable to produce fluids through drill string 40. As such, flapper valve 104 is moved to the second position (FIG. 4) opening flowbore 90. An object, such as a drop ball 144 may be introduced into drill string 40 and allowed to fall toward BPV 80. Drop ball 144 engages pivot nub 118 forcing flapper valve 104 to pivot greater than 90° such that hinge end 106 acts against locking ring 129 as shown in FIG. 3. Hinge end 106 forces locking ring 129 in an uphole direction so that flapper valve may pivot into valve receiving portion 98. At this point it should be understood that while described as a drop ball, the object may take on various forms including balls, darts, plugs, and the like. Also, while described as employing an object to shift the flapper, other methods, such as tools, tubing pressure, tubing fluid, and the like may also be employed.

Once flapper valve 104 pivots past 90° from the first position, hinge end 106 disengages from locking ring 129. At this point biasing member 134 acts against and forces selectively shiftable locking member 128 to move axially along longitudinal axis "L" in a downhole direction locking flapper valve 104 open and first side 112 forms part of flowbore 90. That is, when open, first side 112 of flapper valve 104 is exposed to fluids passing uphole. Once flapper valve 104 is locked open, drop ball 144 may be allowed to dissolve opening flowbore 90. Alternatively, additional pressure may be applied causing drop ball 144 to fracture and/or pass beyond locking system 124 to open flowbore 90.

At this point it should be understood that the exemplary embodiments describe a system for actuating a backpressure valve by guiding a flapper valve into contact with a locking ring. The locking ring is shifted axially allowing the flapper valve to move beyond 90° from a closed or flowbore sealing configuration into a recess. Once in the recess, the locking ring shifts back to lock the flapper valve in the recess thereby opening the flowbore to production fluids. It should be understood that while shown as including one flapper valve, the backpressure valve may include any number of valves.

Set forth below are some embodiments of the foregoing disclosure:

Embodiment 1. A downhole tool comprising: a tubular having an outer surface and an inner surface defining a flowbore having a longitudinal axis; and a backpressure valve arranged in the flowbore, the backpressure valve including: a flapper valve including a hinge end, a cantilevered end, a first side and an opposing second side pivotally mounted to the inner surface at the hinge end to selectively extend across the flowbore; and a locking system mounted to the inner surface adjacent to the hinge end of the flapper valve in the flowbore, wherein the flapper valve is pivotable between a first position, wherein the flapper valve is free to pivot relative to the inner surface between an open configuration and a closed configuration, and a second position, wherein the hinge end of the flapper valve activates the locking system to lock the flapper valve in the open configuration.

Embodiment 2. The downhole tool according to any prior embodiment, wherein the tubular includes a valve seat, wherein the first side of the flapper valve selectively seals against the valve seat.

Embodiment 3. The downhole tool according to any prior embodiment, wherein the valve seat is integrally formed with the tubular.

Embodiment 4. The downhole tool according to any prior embodiment, wherein the locking system includes a selectively shiftable locking member mounted to the inner surface.

Embodiment 5. The downhole tool according to any prior embodiment, wherein the inner surface includes a recess portion, the selectively shiftable locking member defining a locking ring arranged in the recess portion.

Embodiment 6. The downhole tool according to any prior embodiment, further comprising: a spring arranged in the recess portion, the spring biasing the selectively shiftable locking member toward the flapper valve.

Embodiment 7. The downhole tool according to any prior embodiment, wherein the inner surface includes a recess, the flapper valve being mounted in the recess.

Embodiment 8. The downhole tool according to any prior embodiment, wherein the first position is spaced from the second position a distance that is greater than 90°.

Embodiment 9. A resource exploration and recovery system comprising: a first system; a second system fluidically connected to the first system, the second system including at least one tubular extending into a formation, the at least one tubular supporting a downhole tool and including an outer surface and an inner surface defining a flow path having a longitudinal axis, the downhole tool comprising: a backpressure valve arranged in the flow path, the backpressure valve including: a flapper valve including a hinge end, a cantilevered end, a first side and an opposing second side pivotally mounted to the inner surface at the hinge end to selectively extend across the flowbore; and a locking system mounted to the inner surface adjacent to the hinge end of the flapper valve in the flowbore, wherein the flapper valve is pivotable between a first position, wherein the flapper valve is free to pivot relative to the inner surface between an open configuration and a closed configuration, and a second position, wherein the hinge end of the flapper valve activates the locking system to lock the flapper valve in the open configuration.

Embodiment 10. The resource exploration and recovery system according to any prior embodiment, wherein the tubular includes a valve seat, wherein the first side of the flapper valve selectively seals against the valve seat.

Embodiment 11. The resource exploration and recovery system according to any prior embodiment, wherein the valve seat is integrally formed with the tubular.

Embodiment 12. The resource exploration and recovery system according to any prior embodiment, wherein the locking system includes a selectively shiftable locking member mounted to the inner surface.

Embodiment 13. The resource exploration and recovery system according to any prior embodiment, wherein the inner surface includes a recess portion, the selectively shiftable locking member defining a locking ring arranged in the recess portion.

Embodiment 14. The resource exploration and recovery system according to any prior embodiment, further comprising: a spring arranged in the recess portion, the spring biasing the selectively shiftable locking member toward the flapper valve.

Embodiment 15. The resource exploration and recovery system according to any prior embodiment, wherein the inner surface includes a recess, the flapper valve being mounted in the recess.

Embodiment 16. The resource exploration and recovery system according to any prior embodiment, wherein the first position is spaced from the second position a distance that is greater than 90°.

Embodiment 17. A method of operating a backpressure valve comprising: pivoting a flapper valve to a closed configuration to prevent fluid flow through flowbore in a backpressure valve during a milling operation; pumping off a bottom hole assembly at a completion of the milling operation; introducing an object into a tubular string supporting the backpressure valve; shifting a flapper valve to an open configuration with the object; shifting a locking mechanism with a hinge end of the flapper valve; and releasing the locking mechanism to lock the flapper valve in the open configuration, the flapper valve forming a surface of the flowbore.

Embodiment 18. The method according to any prior embodiment, wherein locking the flapper valve open includes urging the flapper valve against the locking mechanism to bias the locking mechanism in an uphole direction away from the flapper valve.

Embodiment 19. The method according to any prior embodiment, wherein locking the flapper valve open further includes biasing the locking mechanism in a downhole direction toward the flapper valve.

Embodiment 20. The method according to any prior embodiment, wherein shifting the locking mechanism with a hinge end of the flapper valve includes pivoting the flapper valve a distance that is greater than about 90° from the closed configuration into a valve receiving recess.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another.

The terms "about" and "substantially" are intended to include the degree of error associated with measurement of the particular quantity based upon the equipment available at the time of filing the application. For example, "about" and/or "substantially" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A downhole tool comprising:

a tubular having an outer surface and an inner surface defining a flowbore having a longitudinal axis; and a backpressure valve arranged in the flowbore, the backpressure valve including:

a flapper valve including a hinge end, a cantilevered end, a first side and an opposing second side pivotally mounted to the inner surface at the hinge end to selectively extend across the flowbore; and a locking system mounted to the inner surface adjacent to the hinge end of the flapper valve in the flowbore, wherein the flapper valve is pivotable between a first position, wherein the flapper valve is free to pivot relative to the inner surface between an open configuration and a closed configuration, and a second position, wherein the locking system acts upon the hinge end of the flapper valve to lock the flapper valve in the open configuration.

2. The downhole tool according to claim 1, wherein the tubular includes a valve seat, wherein the first side of the flapper valve selectively seals against the valve seat.

3. The downhole tool according to claim 2, wherein the valve seat is integrally formed with the tubular.

4. The downhole tool according to claim 1, wherein the locking system includes a selectively shiftable locking member mounted to the inner surface.

5. The downhole tool according to claim 4, wherein the inner surface includes a recess portion, the selectively shiftable locking member defining a locking ring arranged in the recess portion.

6. The downhole tool according to claim 5, further comprising: a spring arranged in the recess portion, the spring biasing the selectively shiftable locking member toward the flapper valve.

7. The downhole tool according to claim 1, wherein the inner surface includes a recess, the flapper valve being mounted in the recess.

8. The downhole tool according to claim 1, wherein the first position is spaced from the second position a distance that is greater than 90°.

9. A resource exploration and recovery system comprising:

a first system;

a second system fluidically connected to the first system, the second system including at least one tubular extending into a formation, the at least one tubular supporting a downhole tool and including an outer surface and an inner surface defining a flow path having a longitudinal axis, the downhole tool further comprising:

a backpressure valve arranged in the flow path, the backpressure valve including:

a flapper valve including a hinge end, a cantilevered end, a first side and an opposing second side pivotally mounted to the inner surface at the hinge end to selectively extend across the flowbore; and a locking system mounted to the inner surface adjacent to the hinge end of the flapper valve in the flowbore, wherein the flapper valve is pivotable between a first position, wherein the flapper valve is free to pivot relative to the inner surface between an open configuration and a closed configuration, and a second position, wherein the locking system acts upon the hinge end of the flapper valve to lock the flapper valve in the open configuration.

10. The resource exploration and recovery system according to claim 9, wherein the tubular includes a valve seat, wherein the first side of the flapper valve selectively seals against the valve seat.

11. The resource exploration and recovery system according to claim 10, wherein the valve seat is integrally formed with the tubular.

12. The resource exploration and recovery system according to claim 9, wherein the locking system includes a selectively shiftable locking member mounted to the inner surface.

13. The resource exploration and recovery system according to claim 12, wherein the inner surface includes a recess portion, the selectively shiftable locking member defining a locking ring arranged in the recess portion.

14. The resource exploration and recovery system according to claim 13, further comprising: a spring arranged in the recess portion, the spring biasing the selectively shiftable locking member toward the flapper valve.

15. The resource exploration and recovery system according to claim 9, wherein the inner surface includes a recess, the flapper valve being mounted in the recess.

16. The resource exploration and recovery system according to claim 9, wherein the first position is spaced from the second position a distance that is greater than 90°.

17. A method of operating a backpressure valve supported by a tubular string, the backpressure valve comprising:

pivoting a flapper valve to a closed configuration to prevent fluid flow through flowbore in the backpressure valve during a milling operation;

pumping off a bottom hole assembly at a completion of the milling operation;

introducing an object into the tubular string;

shifting a flapper valve to an open configuration with the object;

shifting a locking mechanism with a hinge end of the flapper valve; and releasing the locking mechanism to lock the flapper valve in the open configuration, the flapper valve forming a surface of the flowbore.

18. The method of claim 17, wherein locking the flapper valve open includes urging the flapper valve against the locking mechanism to bias the locking mechanism in an uphole direction away from the flapper valve.

19. The method of claim 18, wherein locking the flapper valve open further includes biasing the locking mechanism in a downhole direction toward the flapper valve.

20. The method of claim 17, wherein shifting the locking mechanism with a hinge end of the flapper valve includes pivoting the flapper valve a distance that is greater than about 90° from the closed configuration into a valve receiving recess.

* * * * *